US005626231A

United States Patent [19]

Kwong et al.

[11] Patent Number: 5,626,231

[45] Date of Patent: May 6, 1997

[54] CRATE AND PALLET ASSEMBLY

[75] Inventors: Cyril P. Kwong, Quincy; Mark E. Tellam, Boston, both of Mass.; Gregg R. King, Londonderry, N.H.; Viwanna Buck, Reading, Mass.

[73] Assignee: AGFA Division, Bayer Corp., Wilmington, Mass.

[21] Appl. No.: 562,662

[22] Filed: Nov. 27, 1995

[51] Int. Cl.[6] ..... B65D 19/44

[52] U.S. Cl. ..... 206/600; 206/386; 206/523; 220/1.5; 108/54.1; 248/346.05

[58] Field of Search ..... 206/386, 599, 206/600, 523; 220/1.5; 108/54.1, 52.1; 248/346.05, 346.06, 346.07

[56] References Cited

U.S. PATENT DOCUMENTS

| | | | |
|---|---|---|---|
| 1,104,891 | 7/1914 | Heusser | 248/346.05 |
| 2,791,323 | 5/1957 | Schreckengost | 206/366 |
| 2,828,931 | 4/1958 | Harvey | 108/54.1 |
| 2,942,827 | 6/1960 | Edson | 108/54.1 |
| 4,216,933 | 8/1980 | Cramer | 248/346.06 |
| 5,356,014 | 10/1994 | Berner | 206/600 |
| 5,381,915 | 1/1995 | Yardley | 206/600 |

*Primary Examiner*—Paul T. Sewell
*Assistant Examiner*—Luan K. Bui
*Attorney, Agent, or Firm*—Julie A. Krolikowski; John A. Merecki

[57] ABSTRACT

A pallet assembly for supporting and protecting a load during transportation of the load. The pallet comprises two elongated members spaced apart and oriented substantially parallel so as to be located on opposite sides of the load. A plurality of support members support the load with a clearance space between the support members and the ground. The support members are removably attached to the two elongated members. An adjusting mechanism adjusts the support members relative to the two elongated members to lower the support members toward the ground and reduce the clearance space between the support members and the ground.

16 Claims, 3 Drawing Sheets

CRATE AND PALLET ASSEMBLY

BACKGROUND OF THE INVENTION

Pallets have long been used to transport heavy and/or large loads that require lifting by industrial machines, such as fork lifts and cranes. Some loads are small units loaded in groups onto a pallet to transport large quantities of the small units simultaneously. When transporting these groups of small units, unloading the pallet is relatively easy since the small units can be removed individually from the pallet. Also in cases such as paper transporting, the load is not very sensitive to vibration and shock damage. Therefore a relatively simple and inexpensive pallet may be used.

Other loads are single large units, such as large machines, which may be transported one unit per pallet. With a single large unit, unloading the pallet after transportation of the unit becomes a complicated and expensive chore, requiring several "riggers" or persons to lift the unit from the pallet and set it on the floor. The chance of physical injury to the riggers is a concern and disadvantage when unloading and installing such large and heavy units into a customer site. Further, a large unloading area is required, as usually some type of ramping system is positioned adjacent to the pallet to roll the machine down to the floor level. When the large units contain fragile machines, some type of shock and vibration absorption system is needed during transporting and unloading. Large forces are applied to the pallet and large unit on the pallet when being lowered to the floor by a fork lift or other means. Some large machines have built in shock absorbers or additional isolators which may be built into the base of the unit or into the wheels of the unit to specifically absorb forces applied to the unit during shipping of the unit on a pallet. Alternatively or in addition to the built in system, a floating deck between the pallet and the large unit can be used to protect the large unit. In this case the floating deck is an isolation system in the pallet in order to protect the large unit. The floating deck has a disadvantage of elevating the center of gravity of the load, reducing the stability during transportation. Additionally, both the built in and the floating deck method for protecting the load increase the cost of the unit and the pallet system respectively.

Accordingly it is a general object of the invention to provide a pallet system that one person can unload a large unit from without requiring extra floor space to unload.

It is an object of the invention to provide a pallet assembly that can be disassembled and removed from the load and that can be reassembled for reuse.

It is a further object of the invention to provide a pallet system having a mechanism for lowering the unit to the floor without the need for special tools, extra floor space, or riggers.

It is an object of the invention to isolate a load being transported on a pallet from the forces, vibration, and shock experienced during transport and unloading, and to lower the center of gravity of the system thereby increasing system stability.

It is also an object of the invention to eliminate the need for auxiliary isolation systems built into a machine being transported on a shipping pallet or as an intermediate isolation system between the machine and the shipping pallet, thereby reducing the over cost of the machine or shipping system.

It is yet another object of the invention to reduce the possibility of physical injury to the persons unloading a large unit from a pallet, and also reduce the liability associated with the risk of injury.

SUMMARY OF THE INVENTION

A pallet assembly is used for supporting and protecting a load during transportation of the load. The pallet comprises two elongated members spaced apart and oriented substantially parallel so as to be located on opposite sides of the load. A plurality of support members support the load with a clearance space between the support members and the ground. The support members are removably attached to the two elongated members and are substantially angled to the two elongated members. An adjusting mechanism adjusts the support members relative to the two elongated members to lower the support members toward the ground and reduce the clearance space between the support members and the ground.

BRIEF DESCRIPTION OF THE DRAWINGS

The features and objects of the invention will become apparent in the following description taken with the accompanying drawings in which.

DETAILED DESCRIPTION OF THE INVENTION

Figure 1:
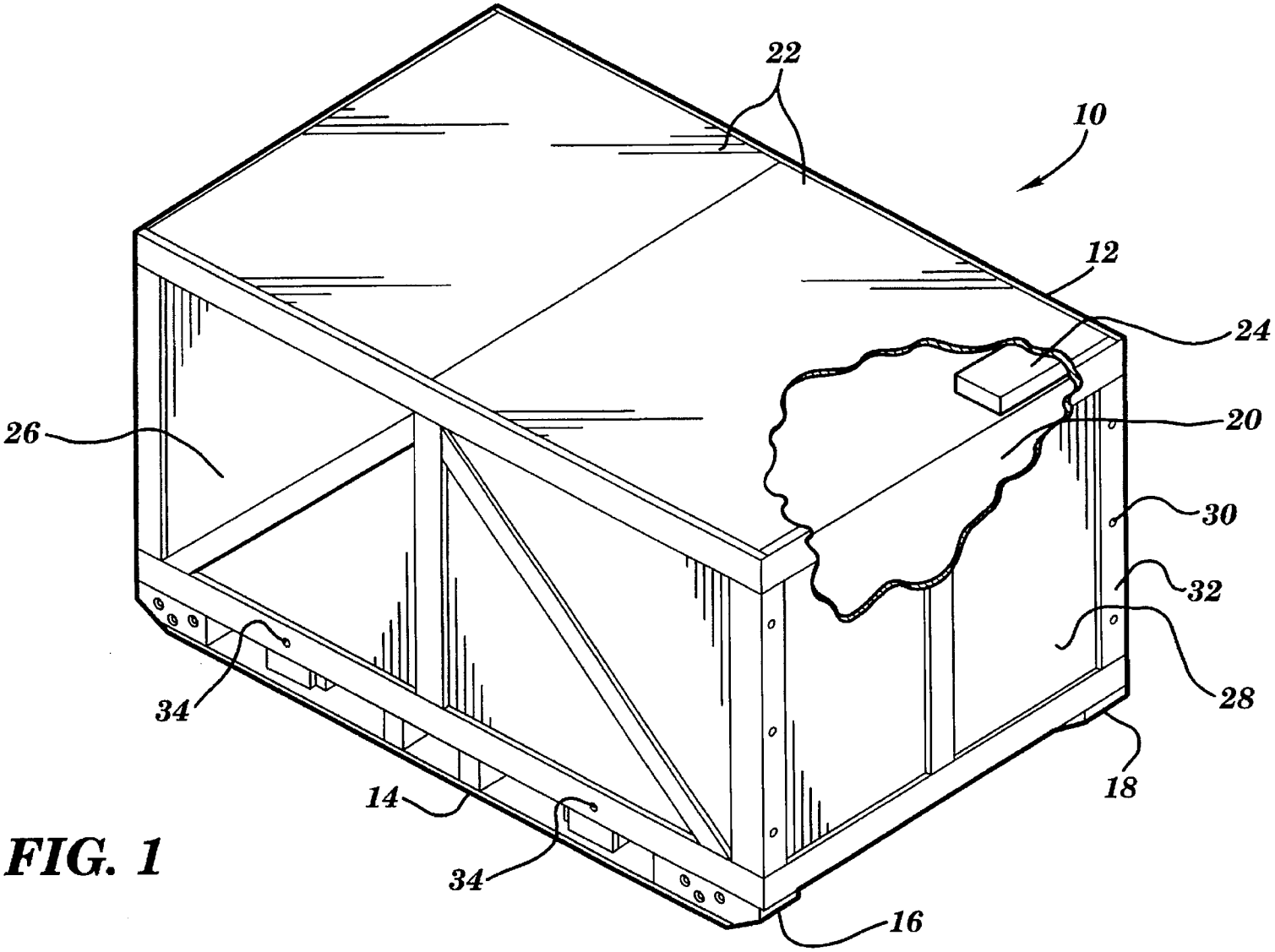
FIG. 1 is an isometric view of a crating system showing a crate and pallet assembly according to the present invention.

The present invention is a crating system shown in FIG. 1, indicated generally by 10. A crate 12 is provided on top of a pallet assembly 14 to facilitate lifting and moving of the crate 12 during shipping. The pallet assembly 14 has two pallet skis 16, 18 spaced apart underneath the crate 12, leaving clearance between the crate bottom and the floor to accommodate the tines of a fork lift (not shown). A fork lift is used to transport the crate 12, for example from a delivery truck into a customer site. A unit 20 contained in the crate 12 is usually uncrated in a work area where the unit 20 is to remain, due to the large size and weight of the unit 20. The crate 12 shown has top covers 22 that are removable without the need of tools. Inside the crate 12 a tool kit 24 is provided to facilitate the customer with the uncrating of the unit 20 in the crate 12. The crate 12 has front and back panels 26 that are connected to opposing side panels 28 by screws 30 in the corner brackets 32 of the panels. The front and back panels 26 are attached to the pallet skis 16, 18 by two screws 34 at the bottom brackets of each panel 26. The customer can easily remove the top covers 22 and access the tool kit 24. The side panels 28 and then the front and back panels 26 are removed from the pallet skis 16, 18 exposing the unit 20 contained therein.

Figure 2:
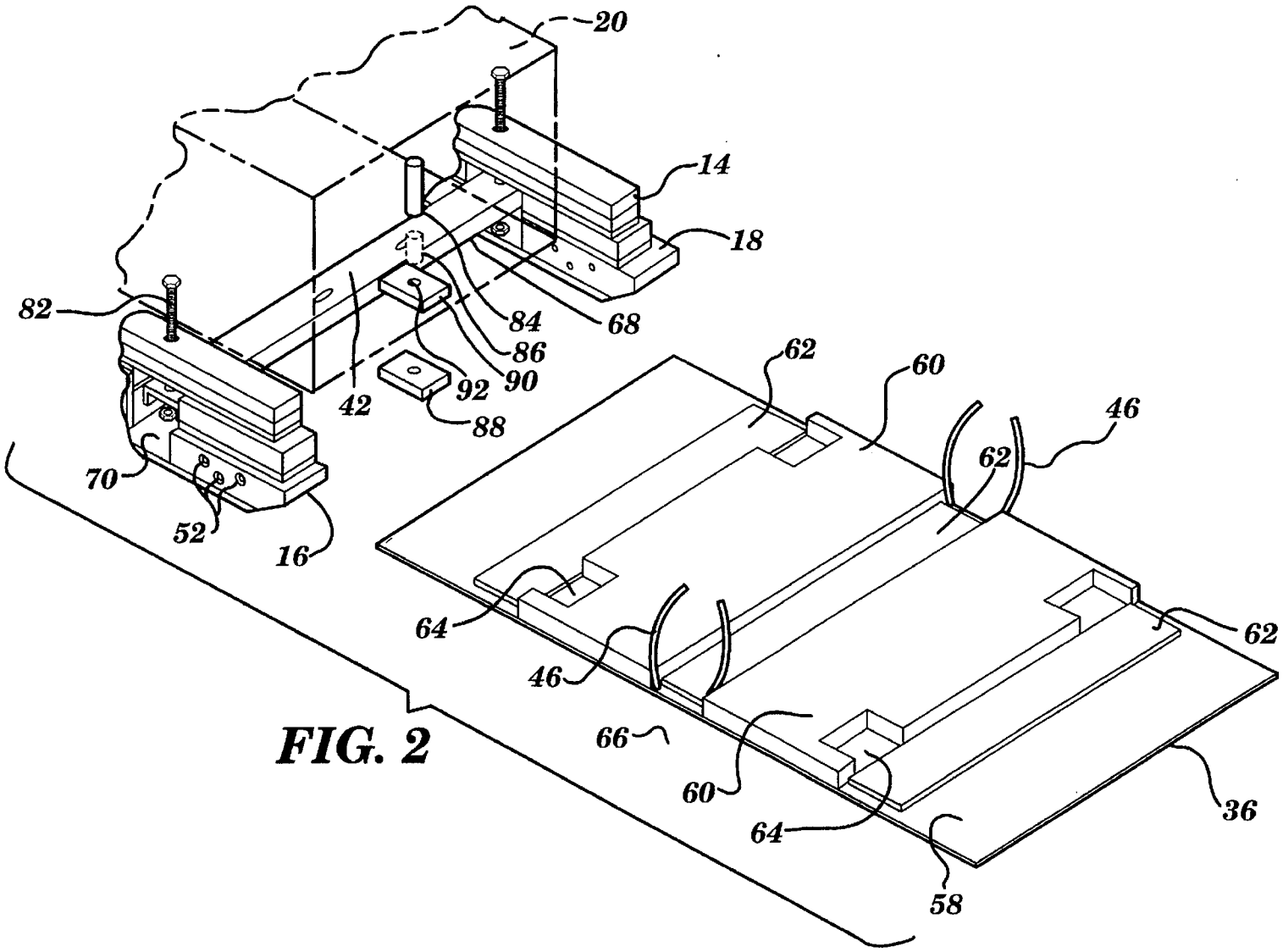
FIG. 2 is an isometric view of a bottom panel of the crate removed from the pallet assembly.
Figure 3:
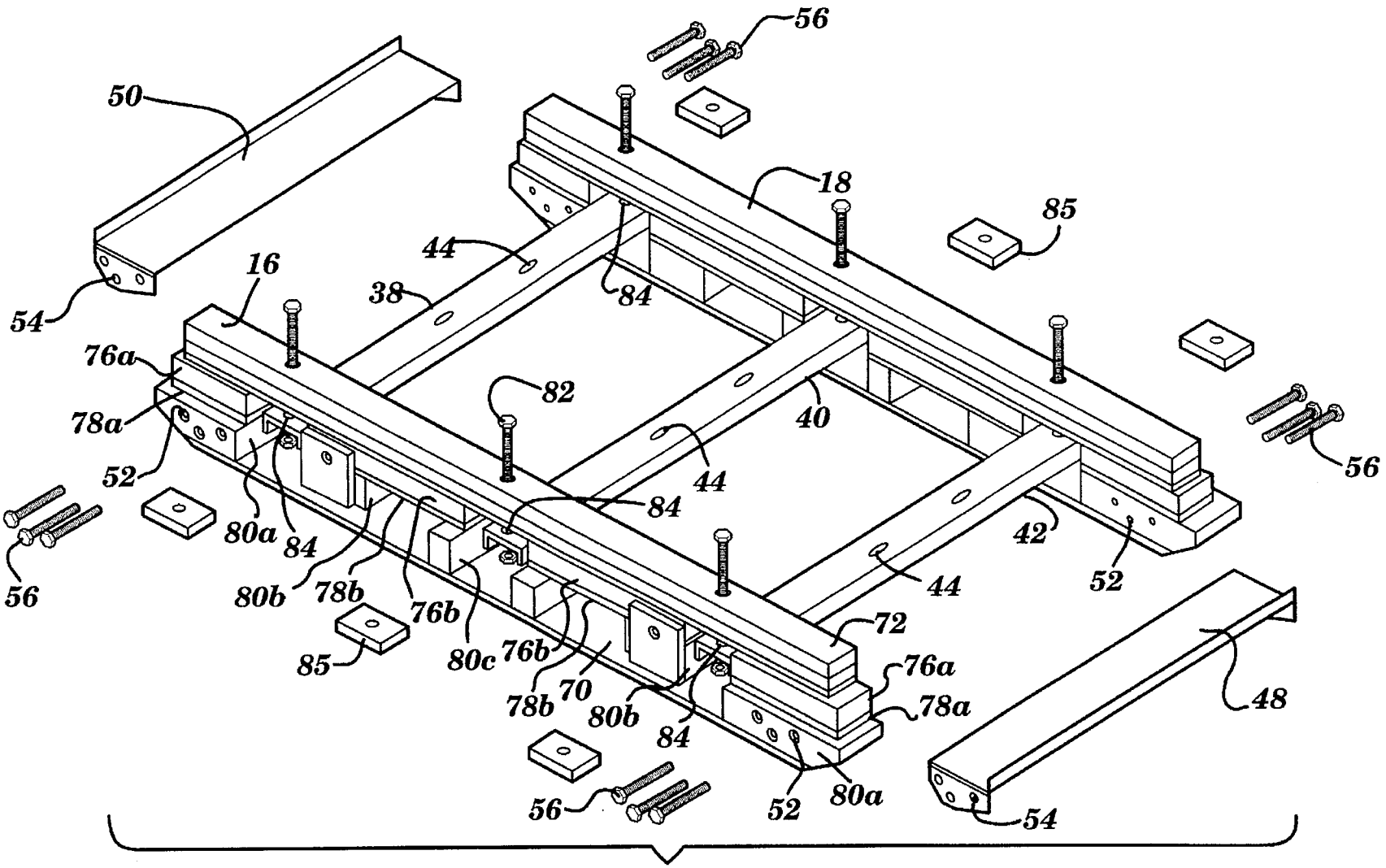
FIG. 3 is a detailed assembly drawing of the pallet construction and support member according to the invention.

Referring now to FIGS. 2 and 3, the unit 20 is supported on the pallet skis 16, 18 by a removable crate bottom 36 and by several cross-bars which are connected to the pallet skis 16, 18. The unit 20 rests directly on three steel support beams 38, 40, 42. The unit 20 is secured to the support beams 38, 40, 42 by screws (not shown) which pass through elongated slots 44 in the beams 38, 40, 42 and screw into the bottom of the unit 20 from the underside of the beams 38, 40, 42. The removable crate bottom 36 is provided with tie-wraps 46 so that the crate bottom 36 is positioned underneath the support beams 38, 40, 42, and then secured to the center support beam 40 by the tie-wraps 46. Two end support brackets 48, 50 are bolted to the pallet skis 16, 18 to support the crate bottom 36 at the outer ends of the pallet skis 16, 18. The end brackets 48, 50 also provide racking resistance in the pallet. That is, the end brackets 48, 50 prevent the pallet skis from skewing relative to the support beams 38, 40, 42, so as to remain perpendicular during shipping for optimal protection of the unit. If skewing of the pallet occurs, stresses applied to the pallet during transport are transferred to the unit and the potential for damage to the unit is increased. The pallet skis 16, 18 are provided with horizontal bolt apertures 52 which align with mounting holes 54 in the end support brackets 48, 50 for mounting bolts 56 to pass through.

The crate bottom 36 is constructed of plywood 58 with thick 60 and thin 62 layers of foam padding attached to the plywood 58 by means of adhesive glue or the like. The areas padded with the thin layers of foam 62 align under the support beams 38, 40, 42 and the thickly padded areas 60 abut against the unit bottom. Cutout areas 64 in the thicker foam padding 60 accommodate wheels or support blocks (not shown) attached to the unit bottom. It can be seen from the configuration of the crate bottom 36 that the unit wheels are closer to the floor 66 than the underside 68 of the support beams 38, 40, 42 when the unit 20 is mounted on the pallet assembly 14. The foam padding 60, 62 provides vibration isolation to the unit 20 during lifting. The crate bottom protects the unit bottom from the tines of the fork lift which would contact the unit bottom directly if the crate bottom were not in place. It will be understood that the crate bottom can be used with or without the front, back, and side panels of the crate. Further, in some cases the crate bottom may be omitted from the shipping pallet assembly if the unit bottom is provided with means for shock absorption, or if the unit is not as sensitive to the forces due to transportation, such as in the described example.

The pallet skis 16, 18 are constructed generally of wood and foam blocks glued to a bottom plywood layer 70. As can be viewed best in FIG. 3, an upper portion of the pallet ski 16 is a elongated member 72 having vertically oriented bores 74. (Pallet ski 18 has identical construction to ski 16. Reference numeral are omitted from the figure for clarity). The elongated member 72 is glued to several polyethylene foam blocks 76*a,b* mounted on plywood 78*a, b*. The foam blocks 76*a,b* are glued to various wooden blocks 80*a,b,c*, including the pallet end blocks 80*a* with the bolt apertures 52 for the mounting bolts 56. The three support beams 38, 40, 42 are adjustably connected to the two pallet skis 16, 18 by vertical screws 82 that pass through the vertical bores 74 in the elongated member 72 and through holes 84 provided in the support beams. Spacers 85 are shown in FIG. 3 for mounting between the elongated member 72 and the support beams 38, 40, 42. The vertical screws 82 pass through bores provided in the spacers 85. The spacers 85 lower the center of gravity of the unit on the support beams 38, 40, 42 relative to the pallet skis, by providing additional space between the elongated member 72 and the support beams so the pallet skis 16, 18 are built up around the front and back ends of the unit for extra protection. The support beams 38, 40, 42 can be lowered by unbolting the screws 82 from the support beams.

The unit 20 is removed from the pallet assembly 14 in the following manner. The mounting bolts 56 are unbolted from the pallet skis 16, 18 in the front and back to remove the end supports 48, 50 from underneath the crate bottom 36. The tie-wraps 46 holding the crate bottom 36 to the center support beam 40 are cut or untied, and the crate bottom 36 becomes detached from the pallet assembly 14 and drops to the floor 66. The crate bottom 36 is then slid out from between the pallet skis 16, 18 and removed. To remove the pallet skis 16, 18 from the unit 20, first the screws (not shown) attaching the three support beams 38, 40, 42 to the unit bottom are loosened to lower the support beams 38, 40, 42 about an eighth of an inch from the unit bottom. The vertical screws 82 holding the center support beam 40 to the pallet skis 16, 18 are unscrewed and removed from the elongated members 72 of the front and back pallet skis 16, 18. The center support beam 40 is slid toward the back of the unit 20 to unhook the elongated slots 44 in the beam 40 from the screws (not shown) in the unit bottom. The screws are then removed from the unit bottom.

Next the remaining four vertical screws 82 are loosened but not removed from the pallet skis 16, 18 in order to lower the support beams 38, 42 from the underside of the elongated members 72 of the pallet skis 16, 18. The bottom of the unit 20 is accommodated with the wheels or supports blocks (not shown) as previously described that come into contact with the floor 66 as the vertical screws 82 are loosened and the support beams 38, 42 are lowered relative to the pallet skis 16, 18. The wheels provide a clearance between the bottom of the unit 20 and the floor 66 so that the support beams 38, 42 can be slid off of the mounting screws (not shown) in the unit bottom, and then slid out from under the unit 20. Then the mounting screws are removed from the unit bottom.

For a unit 20 having a flat bottom (no wheels or support blocks) or clearance that is less than the height of the support beams 38, 40, 42, the removal of the support beams 38, 42 from the pallet skis 16, 18 is facilitated with the use of a jack screw in the following manner. Referring to FIG. 2 from the inside of an end of the unit 20, a jack screw 84 is installed through a channel 86 provided in the unit bottom. A steel plate 88 is inserted under the channel 86 by sliding the plate 88 between the pallet skis 16, 18, to protect the floor 66 from damage by the jack screw 84. The support beam 38 has a bracket 90 attached near the center of the support beam 38. The bracket 90 has a threaded aperture 92 which the jack screw 84 engages to jack the beam 42 and unit resting on it up relative to the floor and to the pallet skis 16, 18. The jack screw 84 is turned within the channel 86 down to the floor 66 such that the unit 20 eventually begins to lift from the floor 66 at that end. Then the unit end is released from the pallet assembly 14 by unbolting the two screws 74 in the front and back pallet skis 16, 18 and then unscrewing the jack screw from the threaded aperture 92, lowering the unit end to the floor 66 as a result. The jack screw 84 is then removed from the channel 86 and installed through a channel in the opposite end of the unit bottom (not shown). The jack screw 84 is again engaged with a threaded aperture in a bracket (not shown) attached to the support beam at the opposite end as described for support beam 42, and lowered to the steel plate, until the unit 20 begins to lift relative to the pallet skis 16, 18. A person may need to hold the opposite end of the unit 20 when jacking up the unit 20, as the unit may tend to slide or roll. The unit end is released from the pallet assembly 14 by unbolting the two screws 74 in the front and back pallet skis 16, 18, and unscrewing the jack screw as for the opposite end, and lowering the unit end to the floor 66 as a result. The jack screw 84 is then removed from the channel.

While this invention has been described in terms of a preferred embodiment, those skilled in the art will appreciate that various modifications, substitutions, omissions and changes may be made without departing from the spirit thereof. Accordingly, it is intended that the scope of the present invention be limited solely by the scope of the following claims, including equivalents thereof.

We claim:

1. A pallet assembly for supporting and protecting a load during transportation of the load, comprising:

two elongated members spaced apart and substantially parallel to one another so as to be located on opposite sides of the load;

a plurality of support means for supporting the load with a clearance space between said support means and the ground, wherein said support means are removably attached to said two elongated members and are substantially perpendicular to said two elongated members; and adjusting means for adjusting the support means relative to said two elongated members to lower said support means and the load supported thereon toward the ground and reduce the clearance space between said support means and the ground.

2. The pallet assembly according to claim 1, further comprising jacking means for jacking the pallet assembly upward relative to the ground so that at least one of said support means can be removed from under the load and for then jacking the pallet assembly downward so that the load is supported on the ground.

3. The pallet assembly according to claim 1, further comprising bracket means for rigidly connecting said two elongated members and preventing skewing of said two elongated members relative to one another during load transportation, protecting the load from damage.

4. A pallet and crate assembly comprising:

two pallet skis substantially parallel to one another and spaced apart;

at least two support beams for directly supporting a load, said support beams connected to said pallet skis so as to be generally perpendicular to said pallet skis and to have a clearance between the support beams and the ground;

height adjustment means for lowering said support beams relative to said pallet skis to lower said support beams and the load supported thereon toward the ground and reduce the clearance space between said support beams and the ground; and means for removing said support beams from under the load so that the load rests on the ground after removal of said support beams.

5. A pallet assembly for supporting and protecting a load during transportation of the load, comprising:

two elongated members spaced apart and substantially parallel to one another so as to be located on opposite sides of the load;

a plurality of support means for supporting the load with a clearance space between said support means and the ground, wherein said support means are removably attached to said two elongated members and are substantially perpendicular to said two elongated members;

adjusting means for adjusting the support means relative to said two elongated members to lower said support means toward the ground and reduce the clearance space between said support means and the ground; and, a removable pallet bottom connected to said pallet assembly underneath said support means, said pallet bottom protecting the load from damage when using a fork lift to lift the pallet assembly by inserting the fork lift tines in between said two elongated members in said clearance space under said support means and under said pallet bottom.

6. The pallet assembly according to claim 5, wherein said pallet bottom is padded with foam to isolate the load from vibration and shock during transportation.

7. The pallet assembly according to claim 5, further comprising bracket means for rigidly connecting said two elongated members and supporting and securing said pallet bottom to said pallet assembly during load transport, said bracket means being detachable from said two elongated members to allow for removal of said pallet bottom from underneath said support means.

8. The pallet assembly according to claim 5, further comprising jacking means for jacking the pallet assembly upward relative to the ground so that at least one of said support means can be removed from under the load and for then jacking the pallet assembly downward so that the load is supported on the ground.

9. The pallet assembly according to claim 5, further comprising bracket means for rigidly connecting said two elongated members and preventing skewing of said two elongated members relative to one another during load transportation, protecting the load from damage.

10. A pallet assembly for supporting and protecting a load during transportation of the load, comprising:

two elongated members spaced apart and substantially parallel to one another so as to be located on opposite sides of the load;

a plurality of support means for supporting the load with a clearance space between said support means and the ground, wherein said support means are removably attached to said two elongated members and are substantially perpendicular to said two elongated members; and adjusting means for adjusting the support means relative to said two elongated members to lower said support means toward the ground and reduce the clearance space between said support means and the ground;

wherein said adjusting means comprises a plurality of bolts passing through a plurality of vertical bores in said two elongated members and then through holes in said support means, and a plurality of nuts mating with said plurality of bolts attaching said support means and said two elongated members, wherein unscrewing said nuts from said bolts lowers said support means relative to said two elongated members.

11. The pallet assembly according to claim 10, further comprising jacking means for jacking the pallet assembly upward relative to the ground so that at least one of said support means can be removed from under the load and for then jacking the pallet assembly downward so that the load is supported on the ground.

12. The pallet assembly according to claim 10, further comprising bracket means for rigidly connecting said two elongated members and preventing skewing of said two elongated members relative to one another during load transportation, protecting the load from damage.

13. The pallet assembly according to claim 10, further comprising a removable pallet bottom connected to said pallet assembly underneath said support means, said pallet bottom protecting the load from damage when using a fork lift to lift the pallet assembly by inserting the fork lift tines in between said two elongated members in said clearance space under said support means and under said pallet bottom.

14. The pallet assembly according to claim 13, wherein said pallet bottom is padded with foam to isolate the load from vibration and shock during transportation.

15. The pallet assembly according to claim 13, further comprising bracket means for rigidly connecting said two elongated members and supporting and securing said pallet bottom to said pallet assembly during load transport, said bracket means being detachable from said two elongated members to allow for removal of said pallet bottom from underneath said support means.

16. A pallet and crate assembly comprising:

two pallet skis substantially parallel to one another and spaced apart;

at least two support beams for directly supporting a load, said support beams connected to said pallet skis so as to be generally perpendicular to said pallet skis and to have a clearance between the support beams and the ground;

means for lowering said support beams relative to said pallet skis;

means for removing said support beams from under the load so that the load rests on the ground after removal of said support beams;

crate sides attached to said pallet skis and to one another to form a crate on top of said pallet skis;

removable top covers supported on said crate sides; and a removable crate bottom attached to the support beams under the support beams.

* * * * *